US006909370B2

(12) United States Patent
Nakamura et al.

(10) Patent No.: US 6,909,370 B2
(45) Date of Patent: Jun. 21, 2005

(54) INTRUDER DETECTION DEVICE AND INTRUDER DETECTION METHOD

(75) Inventors: Hiroaki Nakamura, Ohtsu (JP); Shingo Okawa, Ohtsu (JP); Yoshiharu Okumura, Ohtsu (JP)

(73) Assignee: Optex Co., Ltd., Shiga (JP)

( * ) Notice: Subject to any disclaimer, the term of this patent is extended or adjusted under 35 U.S.C. 154(b) by 66 days.

(21) Appl. No.: 10/216,859

(22) Filed: Aug. 13, 2002

(65) Prior Publication Data

US 2004/0032326 A1 Feb. 19, 2004

(51) Int. Cl.[7] ..... G08B 13/00
(52) U.S. Cl. ..... 340/565
(58) Field of Search ..... 340/541, 565; 250/338.1

(56) References Cited

U.S. PATENT DOCUMENTS

| | | | | |
|---|---|---|---|---|
| 3,958,118 A | | 5/1976 | Schwarz | |
| 4,318,089 A | * | 3/1982 | Frankel et al. | 340/567 |
| 4,614,938 A | | 9/1986 | Weitman | |
| 5,134,292 A | | 7/1992 | Segawa et al. | |
| 5,973,594 A | * | 10/1999 | Baldwin et al. | 340/506 |
| 6,317,040 B1 | * | 11/2001 | Ikeda | 340/522 |
| 2003/0122514 A1 | * | 7/2003 | Mercier et al. | 318/280 |

FOREIGN PATENT DOCUMENTS

| | | |
|---|---|---|
| EP | 0 354 451 | 2/1990 |
| EP | 0 633 554 | 1/1995 |
| EP | 0 867 847 | 9/1998 |
| GB | 2 256 482 | 12/1992 |
| WO | 92/10819 | 6/1992 |

* cited by examiner

*Primary Examiner*—Jeffery Hofsass
*Assistant Examiner*—Jennifer Stone
(74) *Attorney, Agent, or Firm*—Wenderoth, Lind & Ponack, L.L.P.

(57) ABSTRACT

An intruder detection device provides first and second detection areas which are covered by first and second PIR sensors. When intrusion of an object is detected in these areas, the detection signals are amplified by amplifiers, and then processed in a control unit such that orders for generating alarms are output from alarm output units to a monitoring station. While these processed detection signals are output to the alarm output units, the control unit sends other processed signals to LED display units, so that the LED display units turn on alarm lights. The intruder detection device also has a device for separating the object detection areas of the first and second PIR sensors such that their detection areas do not overlap.

18 Claims, 12 Drawing Sheets

INTRUDER DETECTION DEVICE AND INTRUDER DETECTION METHOD

BACKGROUND OF THE INVENTION

The present invention relates to an intruder detection device and an intruder detection method for accurately detecting intrusion of an object (e.g., a person) into a detection area to be monitored.

In general, intruder detection devices equipped with infrared sensors, such as PIR (passive infrared) sensors, are widely popular for their high reliability.

For example, there is an intruder detection device equipped with two PIR sensors. Each of the PIR sensors is composed of a lens or mirror and pyroelectric elements, but, in most cases, the PIR sensors share the lens or mirror for the purpose of cost saving. With a slight adjustment of the positional relationship between the lens or mirror and the pyroelectric elements, detection areas of the PIR sensors are provided without a gap in a vertically or horizontally alternating arrangement.

This intruder detection device outputs a detection signal to a monitoring station when both of the PIR sensors detect an object substantially at the same time.

However, the PIR sensors may generate false alarms if temperature or light varies locally in their detection areas. Specific causes for false alarms include, among others, extraneous light from the sun or car headlights, local heat generated around an air conditioner, heater or facsimile, a small animal, such as a mouse or a pet, or a curtain at the window or a poster hanging from the ceiling which may sway with the wind.

SUMMARY OF THE INVENTION

An object of the present invention is to materialize an intruder detection device and an intruder detection method which utilize a sensor having a plurality of detection elements (e.g., PIR sensors) and which judge whether a detected object is an intruder or not, thereby eliminating false alarms caused by a local change of temperature or light in a detection area.

In order to achieve the above object, the intruder detection device of the present invention is based on a device for detecting an object which enters detection areas covered by detection elements and outputting a detection signal to a monitoring station.

This intruder detection device comprises a sensor unit which has a plurality of detection elements for detecting an object, and a means for separating object detection areas of these detection elements such that the detection areas do not overlap each other.

According to the intruder detection device having the sensor unit and the separation means, a local change of temperature or light in a detection area is detected as an object by a single detection element which covers the particular detection area, whereas such a local change of temperature or light is not detected as an object by any other detection element. As a result, this intruder detection device can reduce false alarms.

The intruder detection device may further comprise a means for changing the proportion of the detection areas to be covered by the plurality of detection elements in an entire detection area which is covered by the plurality of detection elements.

Depending on the installation position of the intruder detection device, the detection operation may be difficult in some part of the detection areas (such part may be also called "a less detectable area"). Nevertheless, the intruder detection device having the detection area changing means can widen the relevant detection area so as to improve detectability in the less detectable area, thereby constantly enabling a stable detection operation throughout the entire detection area. The term "less detectable area" as used herein refers to a detection area where the detection operation of the intruder detection device is hindered by an obstruction (e.g., a drawer) when the intruder detection device is installed in a room.

The intruder detection device may further comprise a means for judging the presence or absence of intrusion of an object based on whether the object is detected by more than one detection element.

Also in this case, a local change of temperature or light in a detection area is detected as an object by a single detection element which covers the particular detection area, whereas such a local change of temperature or light is not detected as an object by any other detection element. Besides, when an object is detected only by the former detection element, the judgment means concludes that no object has entered, and does not output a detection signal to the monitoring station. Consequently, the intruder detection device can eliminate false alarms regarding the presence or absence of an intruder.

In this intruder detection device, the judgment means may determine the presence of an intruder if an object is detected serially over time, by more than one detection element, across more than one detection area, and in the direction in which the object enters or exits from the entire detection area covered by the plurality of detection elements.

In this case, the intruder detection device can detect movement of an object by utilizing more than one detection element, so that the device can judge whether the detected object is an intruder or an irrelevant object such as a curtain. Thus, the intruder detection device can eliminate false alarms.

In such an intruder detection device, one of the plurality of detection elements may cover a detection area which extends at least along an external periphery of the entire detection area covered by the plurality of detection elements. The judgment means may determine the presence of an intruder, if an object is detected by the detection element which covers the external peripheral detection area of the entire detection area, and also if the object is detected later by another detection element which covers another detection area.

When an object enters the entire detection area covered by the plurality of detection elements, the object is always detected at the external peripheral detection area of the entire detection area. Thereafter, the intruder detection device judges whether the object has advanced further into the entire detection area based on whether the object is detected in any other detection area. Accordingly, unless an object is detected by more than one detection element, the intruder detection device never outputs a detection signal to the monitoring station. As a result, the intruder detection device can eliminate false alarms.

In any of the above intruder detection devices, the detection elements may be positive infrared (PIR) sensors or active infrared (AIR) sensors. Alternatively, the detection elements may utilize at least one of a Fresnel lens or a mirror.

Still further, in order to accomplish the above-mentioned object, an intruder detection method of the present invention is based on a method for detecting an object which enters detection areas covered by detection elements and outputting a detection signal to a monitoring station. This intruder detection method comprises the steps of: providing, as an entire detection area, a plurality of detection areas each being covered by a detection element and separated such that the detection areas do not overlap each other; if an object is detected in the plurality of detection areas by the respective detection elements, generating detection signals from the respective detection elements; and, on receiving the detection signals from the respective detection elements, judging that the object is an intruder and outputting the detection signals, independently of each other, to the monitoring station.

According to this intruder detection method, a local change of temperature or light in a detection area is detected as an object by a single detection element which covers the particular detection area, whereas such a local change of temperature or light is not detected as an object by any other detection element. As a result, this intruder detection method can reduce false alarms.

Furthermore, the above object can be achieved by another intruder detection method of the present invention, based on a method for detecting an object which enters detection areas covered by detection elements and outputting a detection signal to a monitoring station. This intruder detection method comprises the steps of: providing, as an entire detection area, a plurality of detection areas each being covered by a detection element and separated such that the detection areas do not overlap each other; if an object is detected in a detection area of one of the detection elements, waiting for a predetermined time in order to see whether the object is detected in a detection area of another detection element; if the latter detection element detects the object during the predetermined waiting time, judging that the object is an intruder and outputting a detection signal to the monitoring station; and, if the latter detection element does not detect the object by the end of the predetermined waiting time, judging that the object is not an intruder and cancelling output of a detection signal to the monitoring station.

According to this intruder detection method, when an object enters the entire detection area covered by the plurality of detection elements, the object is always detected in one of the detection areas of the entire detection area. Subsequently, the intruder detection method judges whether the object has advanced further into the entire detection area, based on whether the object is detected in any other detection area. Consequently, unless an object is detected by more than one detection element, this intruder detection method never outputs a detection signal to the monitoring station. As a result, the intruder detection method can eliminate false alarms regarding the presence or absence of an intruder.

EMBODIMENTS OF THE INVENTION

Embodiments of the present invention are hereinafter described with reference to the drawings.

Figure 1:
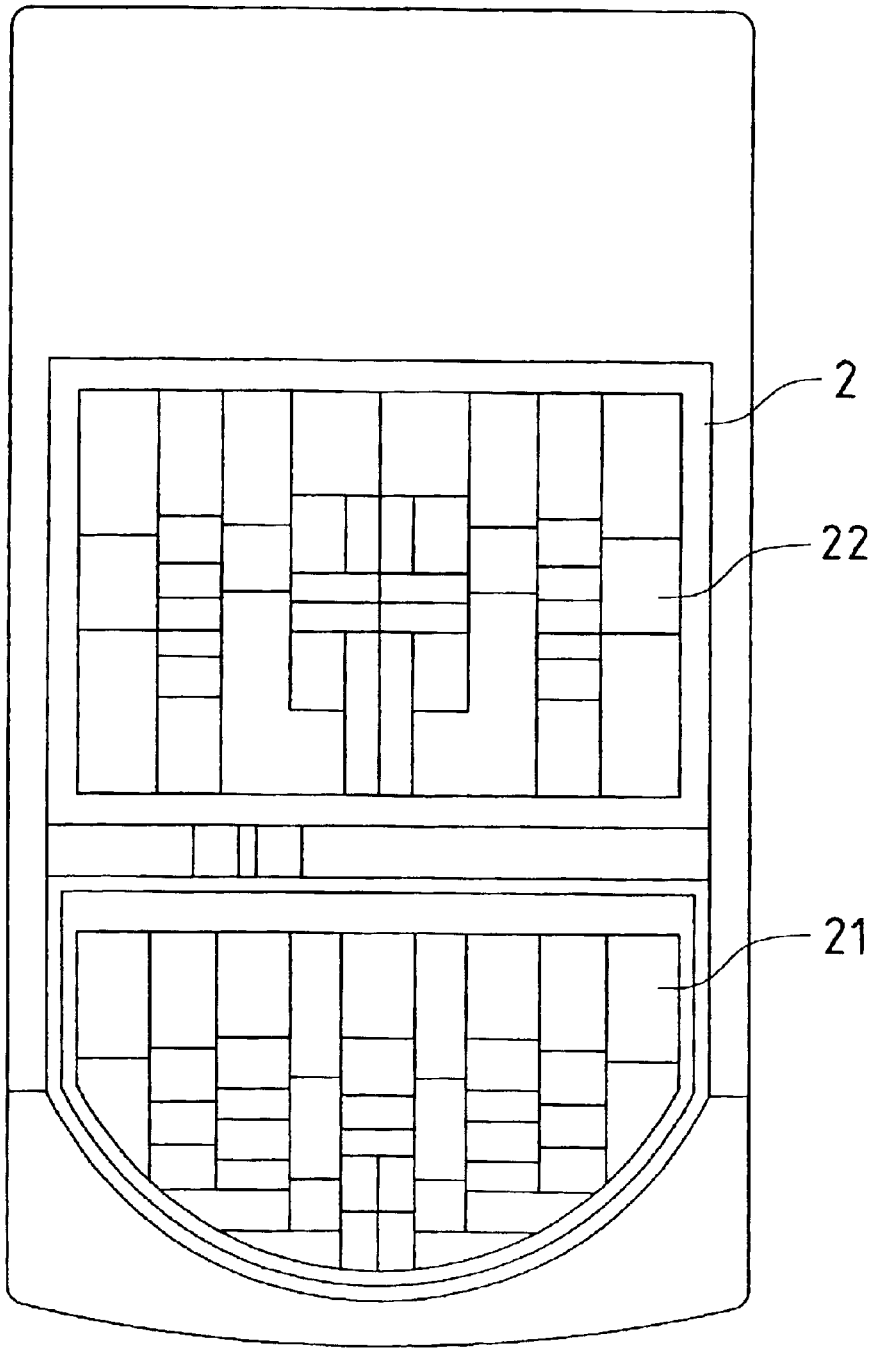
FIG. 1 schematically shows a structure of the intruder detection device concerning Embodiment 1 of the present invention.

FIG. 1 schematically shows a structure of a intruder detection; device 1 concerning Embodiment 1 of the present invention.

As shown in FIG. 1, the intruder detection device 1 has a sensor unit 2 which is equipped with two PIR sensors 21, 22. The intruder detection device 1 detects an object which enters detection areas Al, A2 covered by the PIR sensors 21, 22 (see FIG. 3). The detection signals are amplified by amplifiers 4 (see FIG. 4) and then processed by a control unit 51 (see FIG. 4). In the control unit 51, detection signals to be sent to output units 61, 62 (see FIG. 4) are processed such that orders for generating alarms are output from the output units 61, 62 to a monitoring station. On the other hand, detection signals to LED display units 71, 72 (see FIG. 4) are processed in such a manner as to allow the LED display units 71, 72 to turn on alarm lights. In this description, the term "monitoring station" means, for example, a security system (not shown) in a security company to which the intruder detection device 1 is communicably connected via a control panel (not shown). It should be also noted that the LED display units 71, 72 mentioned herein function as detection confirmation displays for checking whether the intruder detection device 1 has detected an object in its intruder detection area.

This intruder detection device 1 also has a means (system) for separating object detection areas of the PIR sensors 21, 22 such that their detection areas do not overlap.

Figure 2:
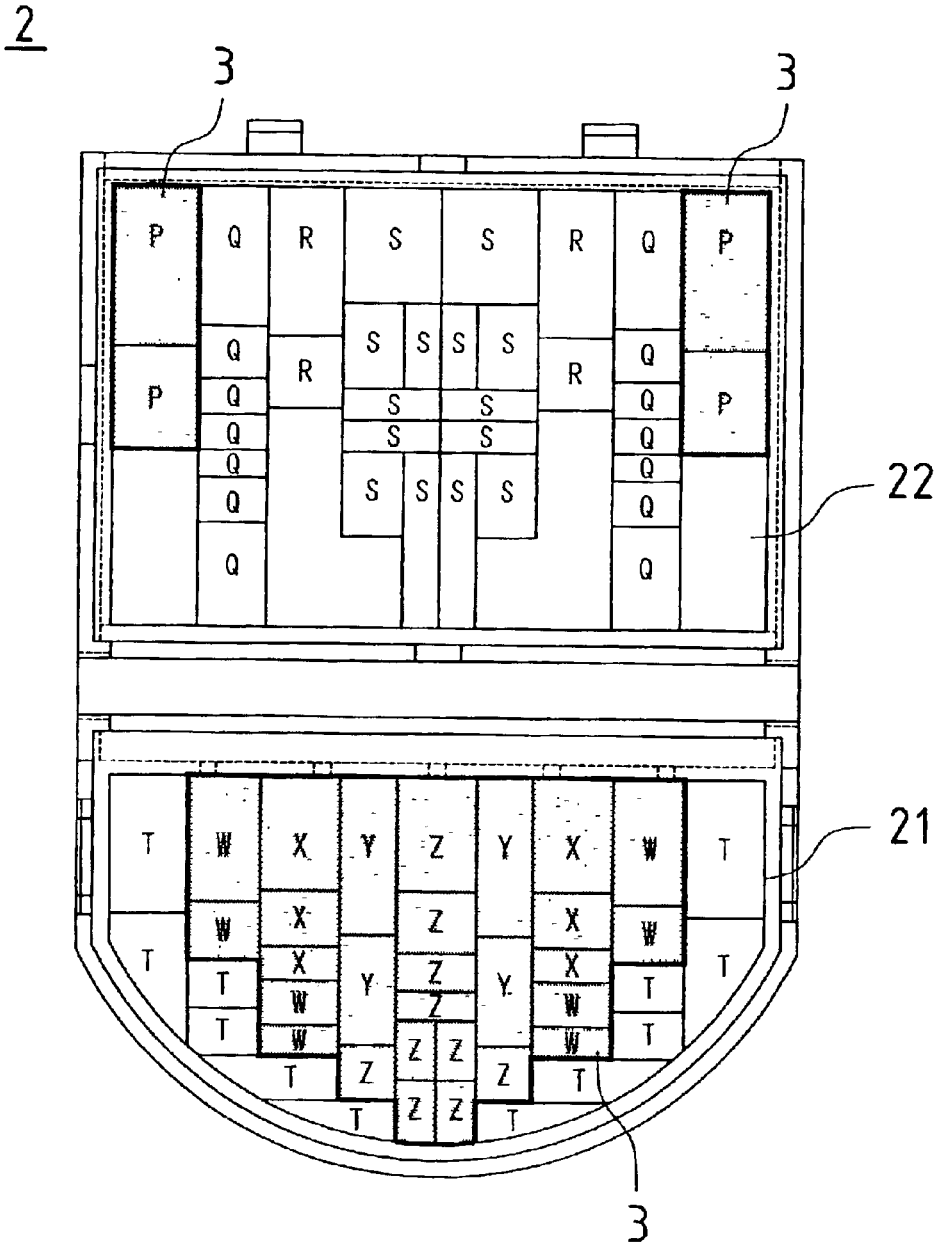
FIG. 2 schematically shows a structure of the sensor unit which is provided in the intruder detection device concerning Embodiment 1 of the present invention.
Figure 3:
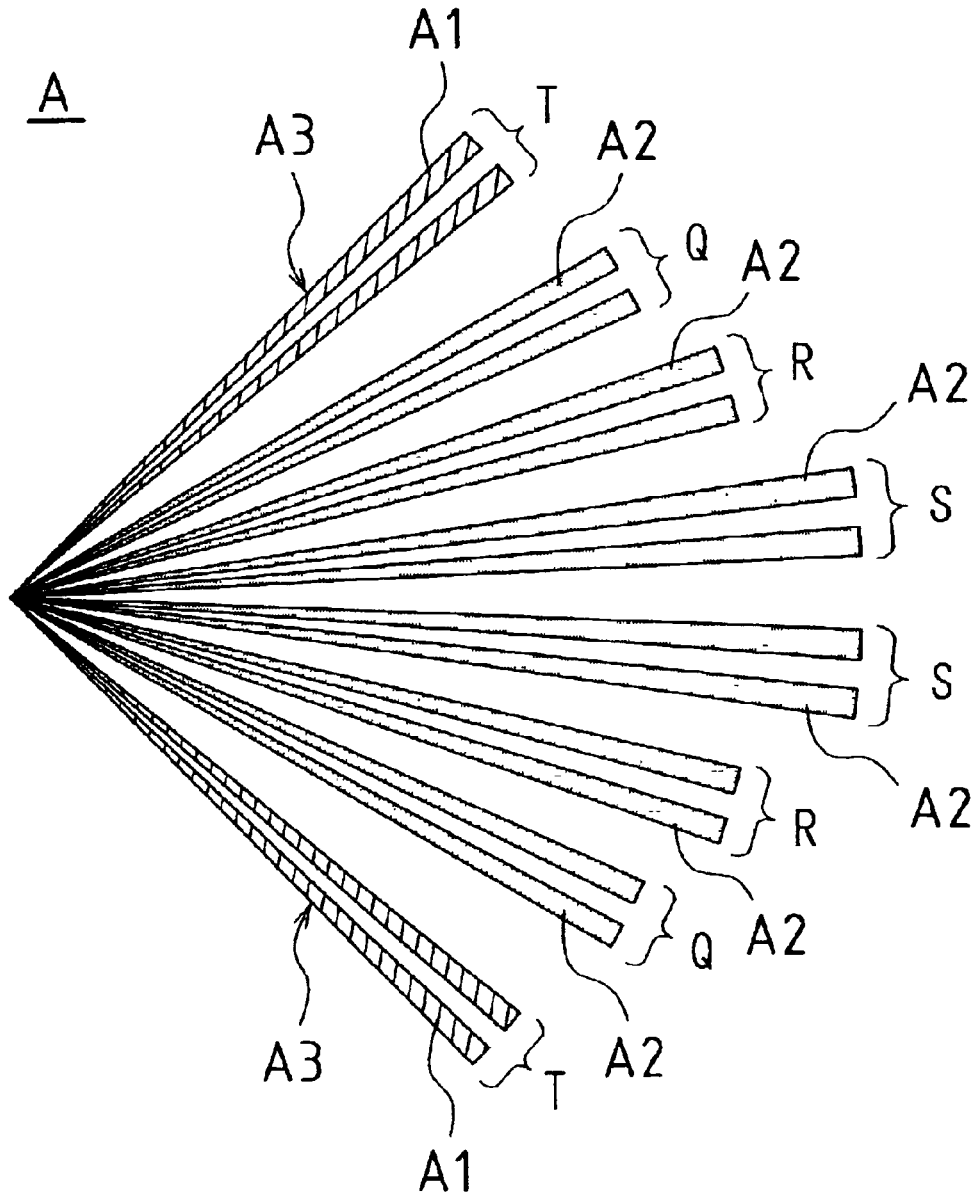
FIG. 3 is a top plan view of the entire detection area concerning Embodiment 1 of the present invention.

Covers 3 are used as the separation means. As illustrated in FIG. 2, the covers 3 removably mask some sections of the sensor unit 2 where the detection areas of the PIR sensors 21, 22 overlap. With the separation means, the detection areas A1, A2 covered by the PIR sensors 21, 22 are separated as shown in FIG. 3. In an entire detection area A which is constituted with the detection areas A1, A2 covered by the PIR sensors 21, 22, the PIR sensor 21 covers the detection areas A1 which extend at least along external peripheries A3 of the entire detection area A. In this respect, FIG. 2 schematically shows the structure of this sensor unit 2, and FIG. 3 is a top plan view of the entire detection area A. The letters Q, R, S and T in FIG. 3 represent the detection areas A1, A2 to be covered by corresponding sections P, Q, R, S, T, W, X, Y and Z of the PIR sensors 21, 22 in the sensor unit 2 of FIG. 2.

Figure 4:
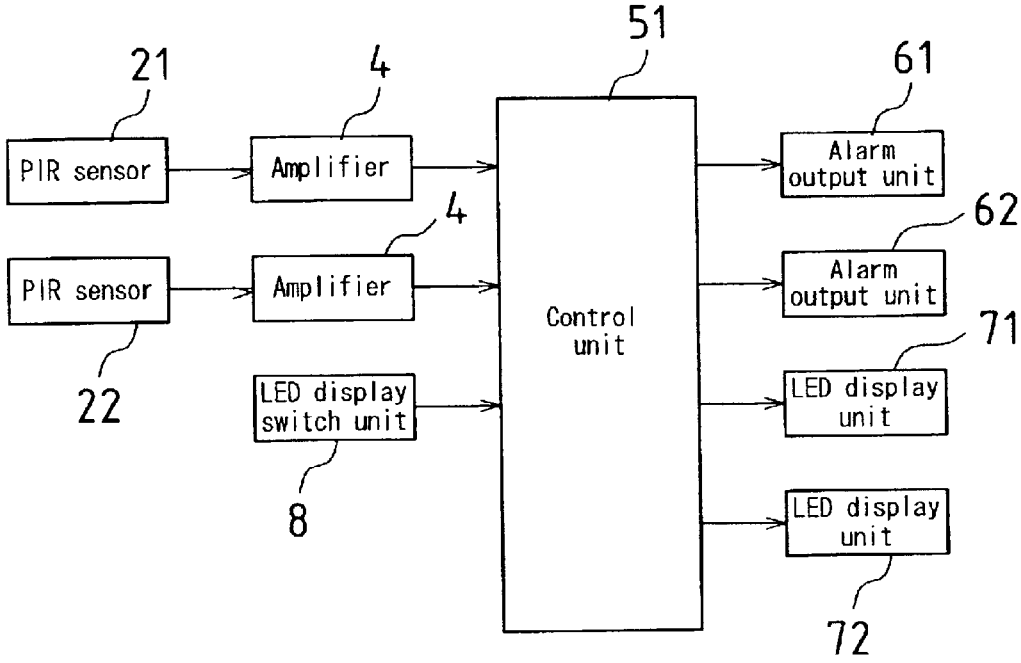
FIG. 4 is a block diagram of the intruder detection device concerning Embodiment 1 of the present invention.

Next, turning to FIG. 4, the operation of this intruder detection device 1 is described below in detail. FIG. 4 is a block diagram of the intruder detection device 1. As mentioned previously, the intruder detection device 1 is communicably connected to the security system of a security company via control panel.

Referring to FIG. 4, when the PIR sensor 21 detects an object in the detection area A1, a detection signal is amplified by the amplifier 4 and sent to the control unit 51. In the control unit 51, the amplified signal is processed such that an order for generating an alarm is output from the alarm output unit 61 to the security system in the security company. The processed detection signal is transmitted to the alarm output unit 61, whereby an order for generating an alarm is output from the alarm output unit 61, via the control panel, to the security system in the security company. When the order is received at the security system of the security company, the system generates an alarm signal. While the processed detection signal is transmitted to the alarm output unit 61, the control unit 51 sends another processed signal to the LED display unit 71 and allows it to turn on an alarm light.

Under such circumstances, it is supposed that the object detected by the PIR sensor 21 is also detected by the PIR sensor 22. As shown in FIG. 4, the detection signal from the PIR sensor 22 is amplified by the amplifier 4 and sent to the control unit 51. In the control unit 51, the amplified signal is processed such that an order for generating an alarm is output from the alarm output unit 62 to the security system in the security company. The processed signal is transmitted to the alarm output unit 62, whereby an order for generating an alarm is output from the alarm output unit 62, via the control panel, to the security system in the security company. When the order is received at the security system of the security company, the system generates an alarm signal. While the processed detection signal is transmitted to the alarm output unit 62, the control unit 51 sends another processed signal to the LED display unit 72 and allows it to turn on an alarm light.

When the two alarm signals, which are generated in response to the orders transmitted from the alarm output units 61, 62, are confirmed at the security company, the detected object is judged to be an intruder.

On the other hand, it is supposed that the object detected by the PIR sensor 21 is not detected by the PIR sensor 22. In this case, the alarm output unit 62 does not output an order for generating an alarm to the security system in the security company. Thus, when only one alarm signal generated by the alarm output unit 61 is confirmed at the security company, the object is considered something other than an intruder.

In this embodiment, the control unit 51 sends the processed detection signals to the alarm output units 61, 62 and also to the LED display units 71, 72. Alternatively, a LED display switch unit 8 can be used to select whether the detection signals should be sent to the LED display units 71, 72. Additionally, since the LED display units 71, 72 are independent of each other, they may utilize different colors of LEDs (e.g., red LEDs for the LED display unit 71 and yellow LEDs for the LED display unit 72), thereby indicating which sensor has detected an object.

According to this intruder detection device 1 which has the sensor unit 2 and the separation means, a local change of temperature or light in a detection area is detected as an object by a single detection element which covers the particular detection area, whereas such a local change is not detected as an object by any other detection element. As a result, this intruder detection device 1 can reduce false alarms.

Besides, movement of an object is detected by the PIR sensors 21, 22 across the detection areas A1, A2. Therefore, based on the detection signals from the PIR sensors 21, 22, it is possible to judge whether the detected object is an intruder or an irrelevant object (e.g., acurtain) , thus eliminating false alarms.

Incidentally, the intruder detection device 1 of Embodiment 1 utilizes two PIR sensors. Nevertheless, the number of PIR sensors can be selected from two or more, without limitation. Further, the type of detection elements should not be limited to PIR sensors as used in Embodiment 1. As far as being capable of detecting an object in the detection areas, any sensors (e.g., AIR sensors) can be employed as such.

In another respect, Embodiment 1 utilizes the covers 3 as the means for separating the entire detection area A into the detection areas A1 and A2. However, the separation means should not be limited to the covers 3. Instead, in order to separate the entire detection area A into the detection areas A1 and A2, the PIR sensors 21, 22 may use a Fresnel lens or mirror which is designed to prevent their detection areas A1, A2 from overlapping each other.

Figure 5:
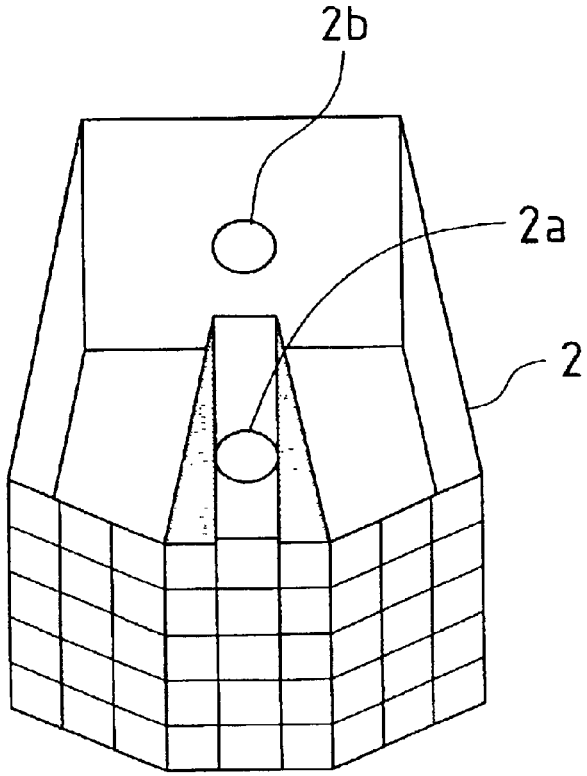
FIG. 5 is a schematic perspective view showing, from the front side, another example of the separation means provided in the intruder detection device concerning Embodiment 1 of the present invention.

As another example, the separation means may have a structure illustrated in FIG. 5. Regarding this separation means, two pyroelectric elements 2*a*, 2*b* are housed in the front part and the rear part of the sensor unit 2. According to this separation means, the front pyroelectric element 2*a* a covers the detection area A2 and the rear pyroelectric element 2*b* covers the detection area A1.

Figure 6:
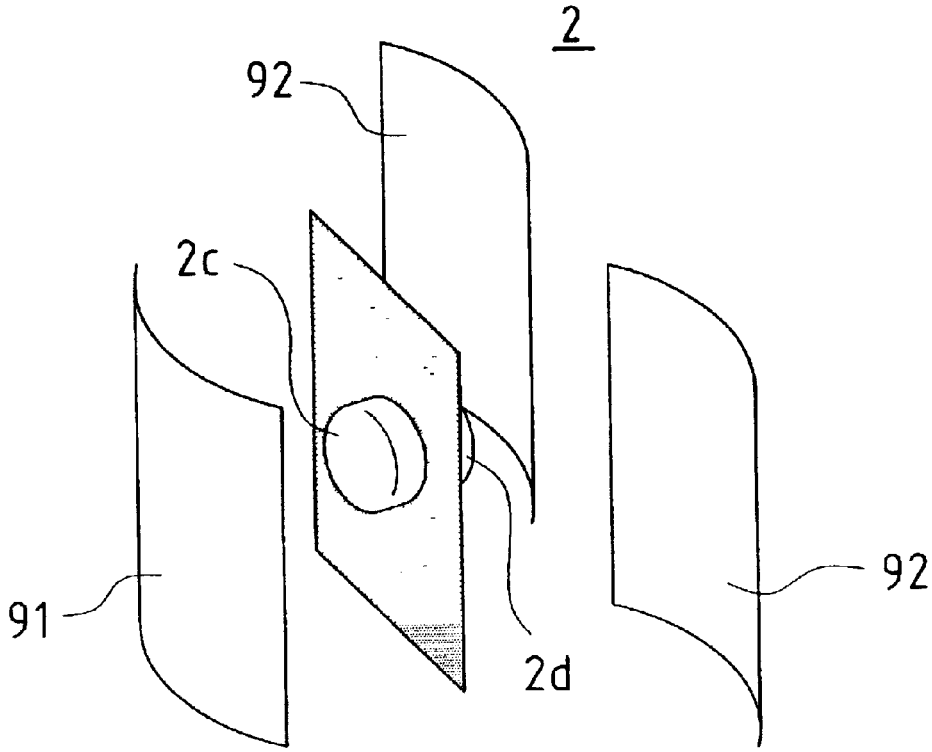
FIG. 6 is a schematic perspective view showing still another example of the separation means provided in the intruder detection device concerning Embodiment 1 of the present invention.
Figure 7:
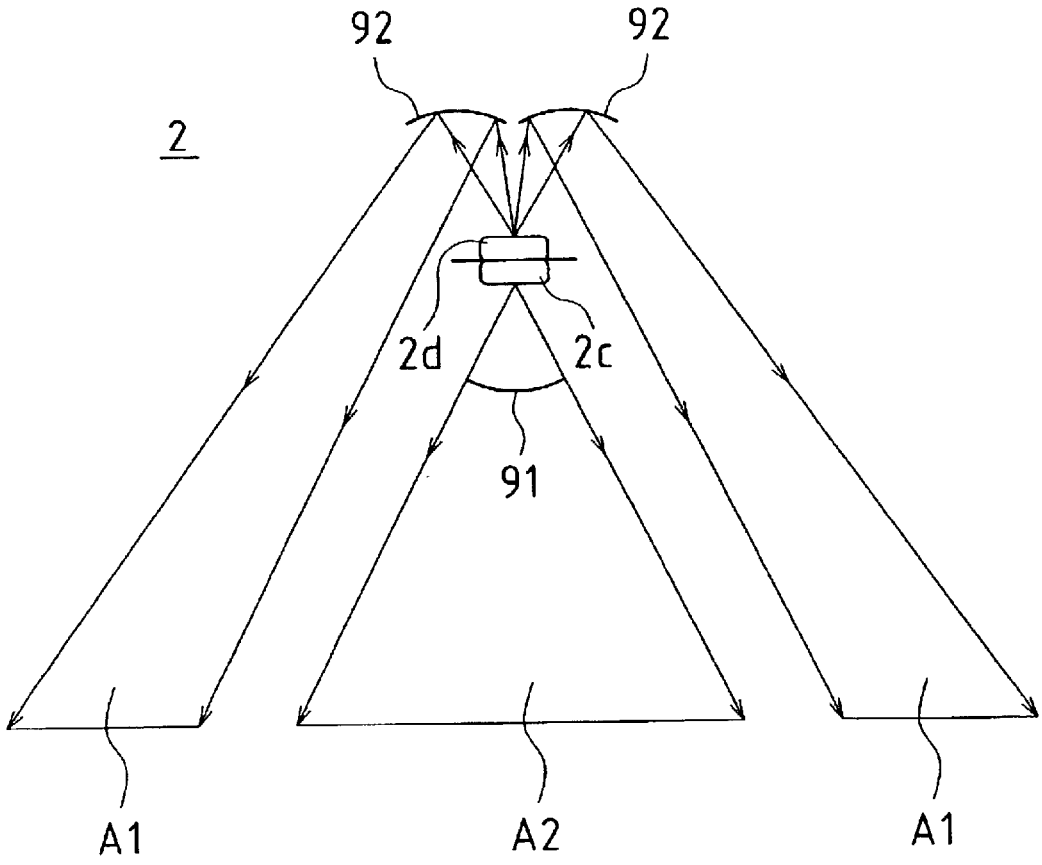
FIG. 7 is a schematic plan view of the separation means of FIG. 6.

Still another example of the separation means is given in FIGS. 6 and 7. Two pyroelectric elements 2*c*, 2*d* are housed in the sensor unit 2, with their optical surfaces oriented back to back with each other. A Fresnel lens 91 is disposed between the front of the sensor unit 2 and the pyroelectric element 2*c* whose optical surface faces to the front of the sensor unit 2. Condenser mirrors 92 are located at the rear part of the sensor unit 2. When an optical system (signal) is emitted from the pyroelectric element 2*d* whose optical surface is directed to the rear of the sensor unit 2, the condenser mirrors 92 reflect the optical system toward the front of the sensor unit 2. According to this separation means, the pyroelectric element 2*c* whose optical surface faces to the front of the sensor unit 2 covers the detection area A2 via the Fresnel lens 91, and the pyroelectric element 2*d* whose optical surface is directed to the rear of the sensor unit 2 covers the detection area A1, via the condenser mirrors 92. The condenser mirrors 92 may be replaced with plane mirrors.

Now, the description is focused on Embodiments 2 and 3 which disclose other types of intruder detection devices which show similar effects as the intruder detection device 1.

Except for the manner of signal processing and signal output performed in the control unit 51, the intruder detection device concerning Embodiment 2 is similar to the intruder detection device 1 of Embodiment 1. Hence, similar constituents as mentioned in Embodiment are indicated by the identical reference signs so as to omit their description. Only the differences from Embodiment 1 are discussed below.

The intruder detection device 1 has a sensor unit 2 which is equipped with two PIR sensors 21, 22, a means for separating object detection areas A1, A2 of the PIR sensors 21, 22 such that their detection areas do not overlap, and a means (a judging section) for judging the presence or absence of intrusion of an object, based on whether the object is detected by the PIR sensors 21, 22.

The judgment means is provided in the control unit 52. If an object is detected by the PIR sensor 21 in either of its detection areas A1 which extend along external peripheries A3 of the entire detection area A, and if the object is later detected by the PIR sensor 22 in its detection area A2, the judgment means determines the presence of an intruder.

Next, turning to FIG. 8, the operation of this intruder detection device 1 is described below in detail. FIG. 6 is a block diagram of the intruder detection device 1.

Figure 8:
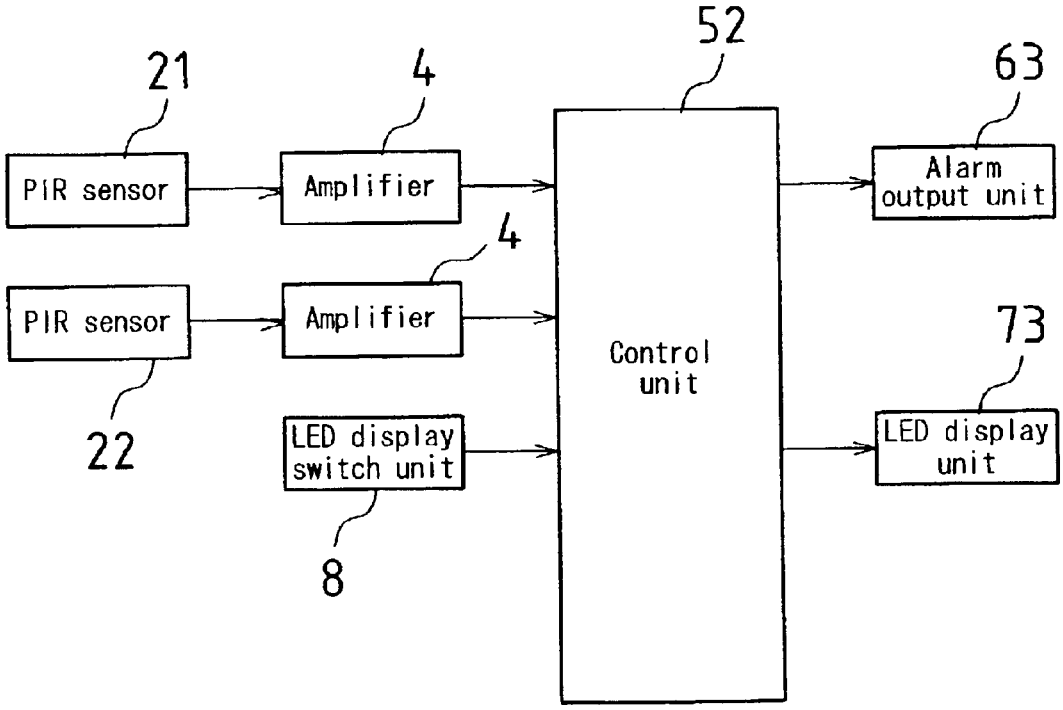
FIG. 8 is a block diagram of the intruder detection device concerning Embodiment 2 of the present invention.

Referring to FIG. 8, when the PIR sensor 21 detects an object in the detection area A1, a detection signal is amplified by the amplifier 4 and sent to a control unit 52.

After receiving the detection signal from the PIR sensor 21, the control unit 52 waits for an output from the PIR sensor 22, with a timer being activated for a predetermined time (e.g., 5 to 10 seconds). If the PIR sensor 22 detects an object within the predetermined waiting time, its detection signal is amplified by the amplifier 4 and sent to the control unit 52, as shown in FIG. 8. When the control unit 52 receives the detection signals from both PIR sensors 21, 22, the detection signals are processed such that an order for generating an alarm is output from an alarm output unit 63 to the security system in the security company. The processed detection signal is transmitted to the alarm output unit 63, whereby an order for generating an alarm is output from the alarm output unit 63, via the control panel, to the security system in the security company. When the order is received at the security system of the security company, the system generates an alarm signal. While the processed detection signal is transmitted to the alarm output unit 63, the control unit 52 sends another processed signal to the LED display unit 73 and allows it to turn on an alarm light.

When the alarm signal, which is generated in response to the order transmitted from the alarm output unit 63, is confirmed at the security company, the detected object is determined to be an intruder.

On the other hand, it is supposed that the object detected by the PIR sensor 21 is not detected by the PIR sensor 22. In this case, the control unit 52 similarly waits for an output from the PIR sensor 22, while the timer is activated for the predetermined time. If the PIR sensor 22 does not detect any object until the timer times out, the control unit 52 judges that the PIR sensor 22 has generated no detection signal (i.e. the earlier detection signal was false). Based on this judgment, the control unit 52 resets the timer and cancels output of the alarm generation order which would be transmitted from the alarm output unit 63, via the control panel, to the security system in the security company.

Further, in order to improve reliability against false alarms, the control unit 52 maybe capable of discriminating the moving direction of an object, according to the detection priority of the PIR sensors 21, 22. To give a specific example, in the case where an intruder breaks in from a window or door, detection signals received by the control unit 52 are considered true only when the control unit 52 receives a detection signal from the PIR sensor 21 before a detection signal from the PIR sensor 22, namely, when the PIR sensor 21 detects the intruder earlier than the PIR sensor 22. If the detection signals come in the reverse order, the signals are considered false. This additional detection condition can further reduce false alarms.

According to the above intruder detection device 1 of the present invention, when an object enters the entire detection area A covered by the PIR sensors 21, 22, the object is always detected in either of the detection areas A1 which extend along external peripheries A3 of the entire detection area A. Thereafter, the intruder detection device 1 judges whether the object has advanced further into the entire detection area A, based on whether the object is detected in the detection area A2. Accordingly, unless an object is detected by both PIR sensors 21, 22, the intruder detection device 1 never outputs detection signals to the monitoring station. As a result, it is possible to eliminate false alarms regarding the presence or absence of an intruder.

The next description deals with the intruder detection device 1 concerning Embodiment 3. This intruder detection device is similar to the intruder detection device 1 of Embodiment 1, except for incorporating a detection area changing means (to be detailed below) to the intruder detection device 1 concerning Embodiment 1. Hence, similar constituents as mentioned in Embodiment 1 are indicated by the identical reference signs so as to omit their description. Only the differences from Embodiment 1 are discussed below.

The intruder detection device 1 has a sensor unit 2 which is equipped with two PIR sensors 21, 22, a means for separating object detection areas of the PIR sensors 21, 22 such that their detection areas do not overlap, and a means for judging the presence or absence of intrusion of an object, based on whether the object is detected by the PIR sensors 21, 22.

In addition, the intruder detection device 1 is provided with a means for changing the proportion of the detection areas to be covered, respectively, by the PIR sensors 21, 22, in the entire detection area A which is covered by the PIR sensors 21, 22.

Figure 9:
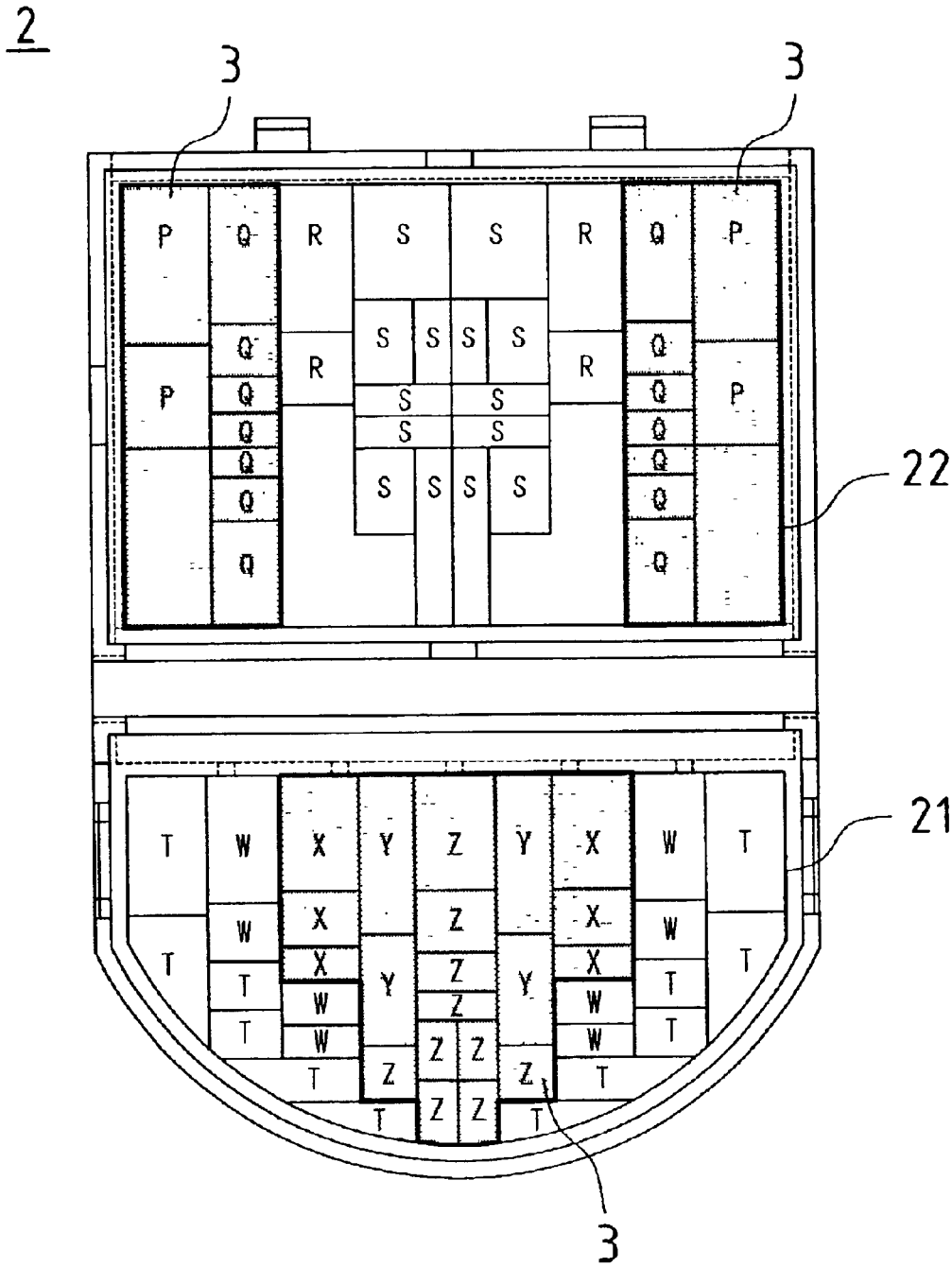
FIG. 9 schematically shows a structure of the sensor unit concerning Embodiment 3 of the present invention.
Figure 10:
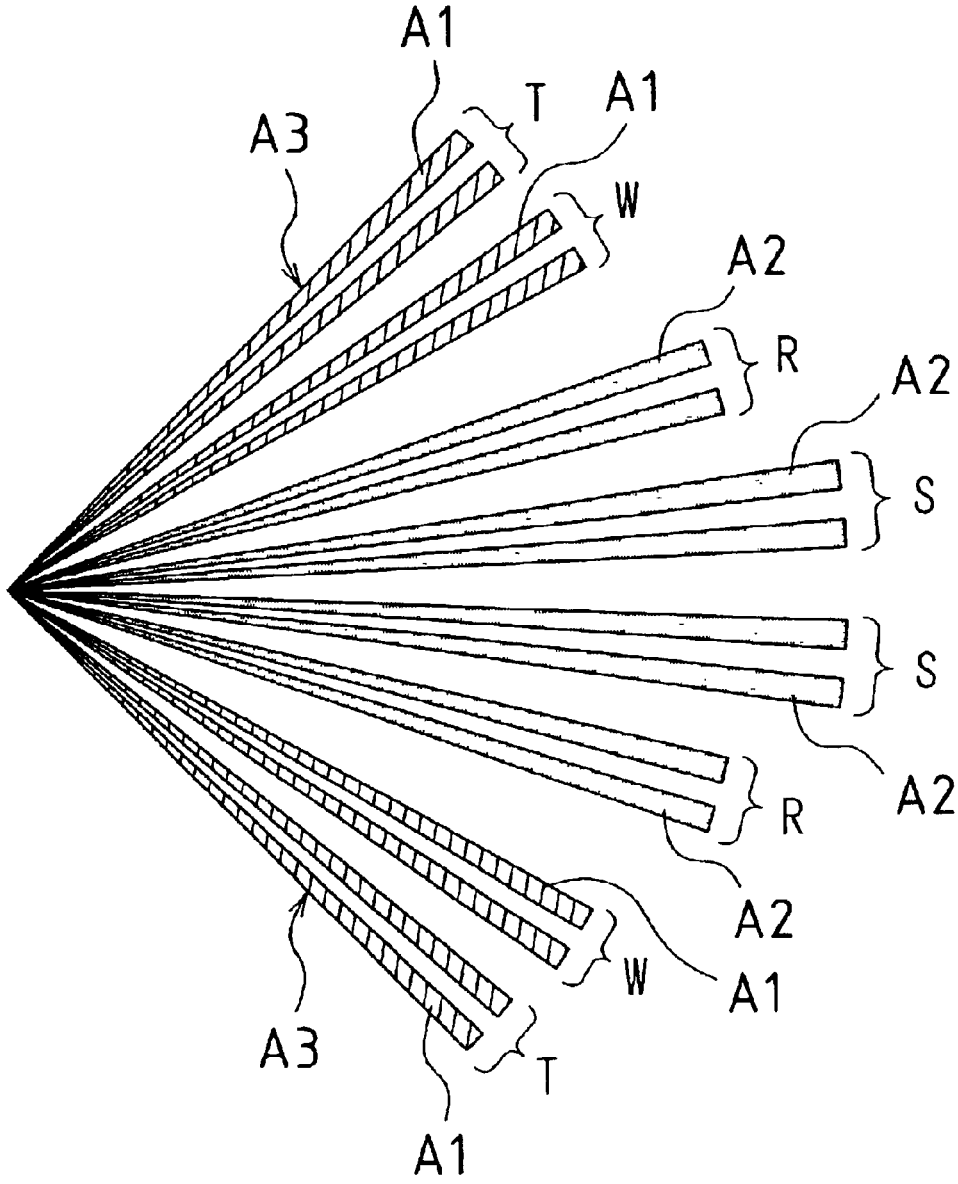
FIG. 10 is a top plan view of an entire detection area, wherein the PIR sensor 21 covers a greater proportion of the detection area and the PIR sensor 22 covers a smaller proportion of the detection area, as compared with Embodiment 1.

The detection area changing means alters the sections of the PIR sensors 21, 22 to be masked with the covers 3. FIG. 9 gives an example of the sensor unit 2 in which the sections masked with the covers 3 are altered by the detection area changing means. FIG. 10 shows the entire detection area A provided by this sensor unit 2. In comparison with Embodiment 1, this detection area A is composed of a greater proportion of the detection area A1 covered by the PIR sensor 21, and a smaller proportion of the detection area A2 covered by the PIR sensor 22. As mentioned, FIG. 9schematically shows the structure of this sensor unit 2. The letters R, S, T and W in FIG. 10 represent the detection areas A1, A2 to be covered by corresponding sections P, Q, R, S, T, W, X, Y and Z of the PIR sensors 21, 22 in the sensor unit 2 of FIG. 9.

Depending on the installation position of the intruder detection device 1, the detection operation may be difficult in some part of the detection areas A1 (such part is hereinafter called "less detectable area".). Nevertheless, the intruder detection device 1 having the detection area changing means can widen the detection areas A1 so as to improve detectability in the less detectable area, thereby constantly enabling a stable detection operation throughout the entire detection area A. The term "less detectable area" as used herein refers to a detection area where the detection operation of the intruder detection device 1 is hindered by an obstruction (e.g., a drawer) when the intruder detection device 1 is installed in a room.

Figure 11:
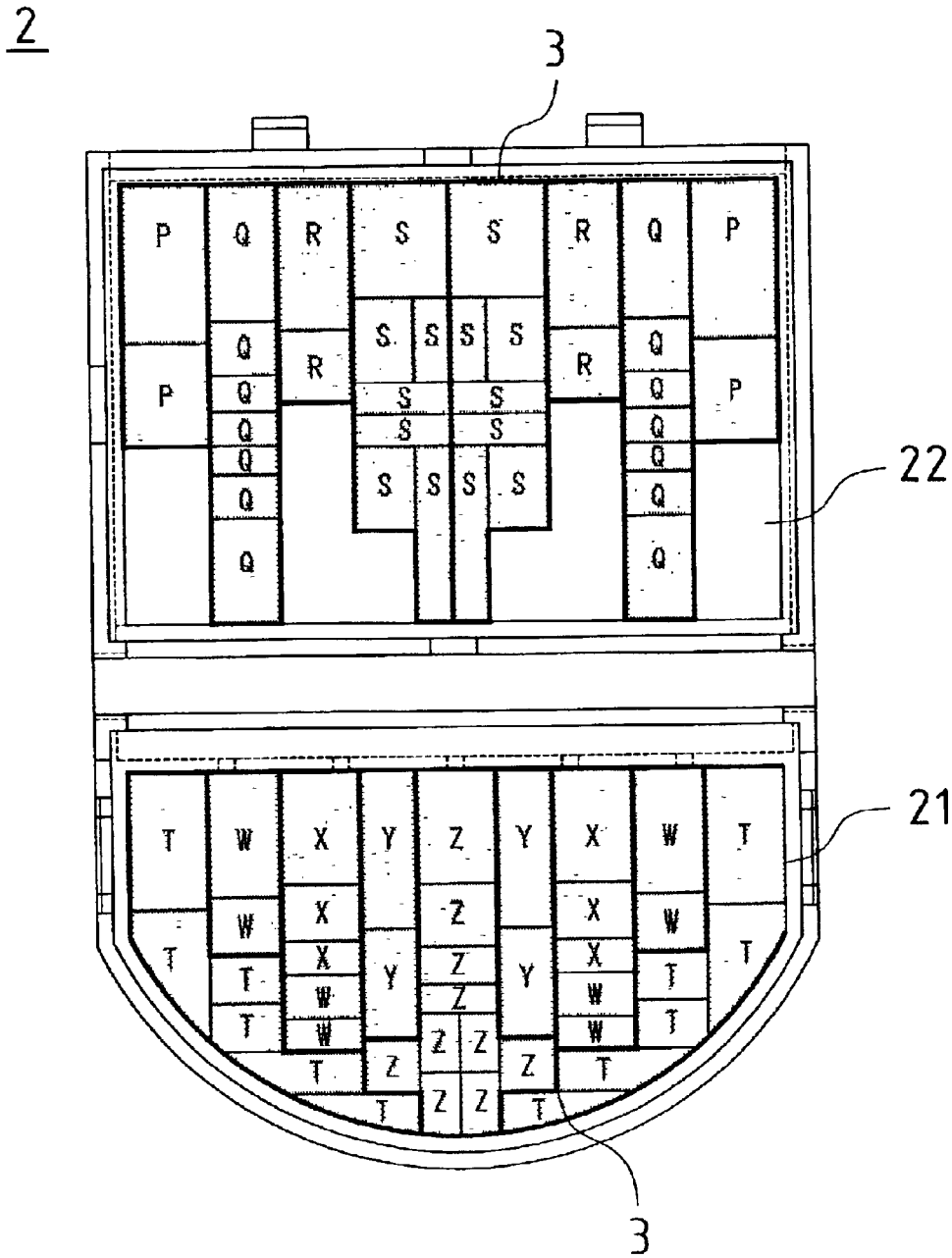
FIG. 11 schematically shows a structure of the sensor unit concerning Embodiment 3 of the present invention, wherein the surfaces of the PIR sensors are completely masked with covers.

In Embodiment 3, the covers 3 are provided in advance as shown in FIG. 9, but they may be provided in any manner without limitation. As an alternative, the surfaces of the PIR sensors 21, 22 may be completely masked with the covers 3 in the initial state, as shown in FIG. 11. These covers 3 can be freely removed to give optional detection areas, according to user's intended applications. In this respect, FIG. 11 schematically shows a structure of the sensor unit 2, wherein the surfaces of the PIR sensors 21, 22 are completely masked with the covers 3.

Figure 12:
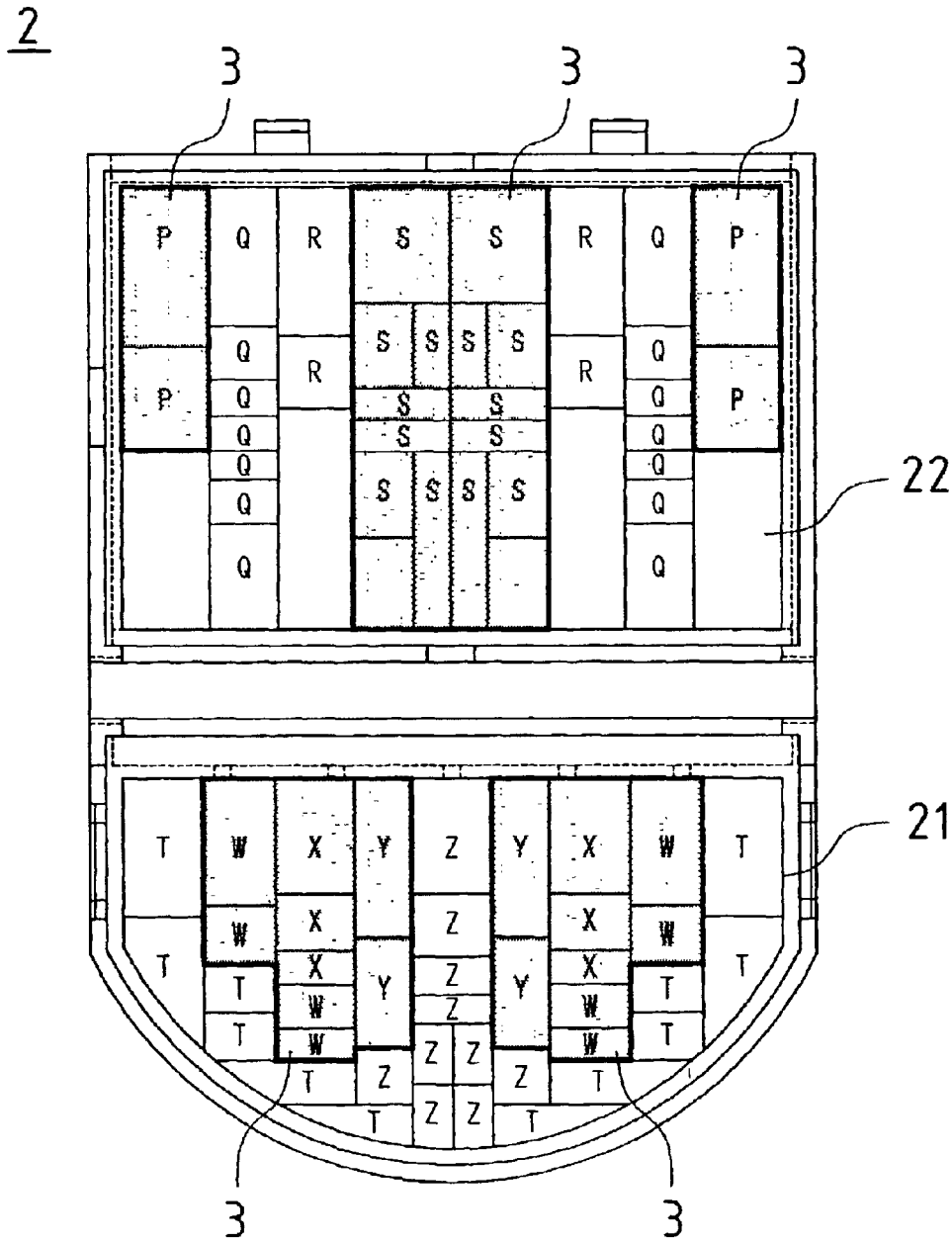
FIG. 12 schematically shows a structure of the sensor unit concerning Embodiment 3 of the present invention, wherein the sections masked with the covers are different from the masked sections in the sensor unit of FIG. 9.
Figure 13:
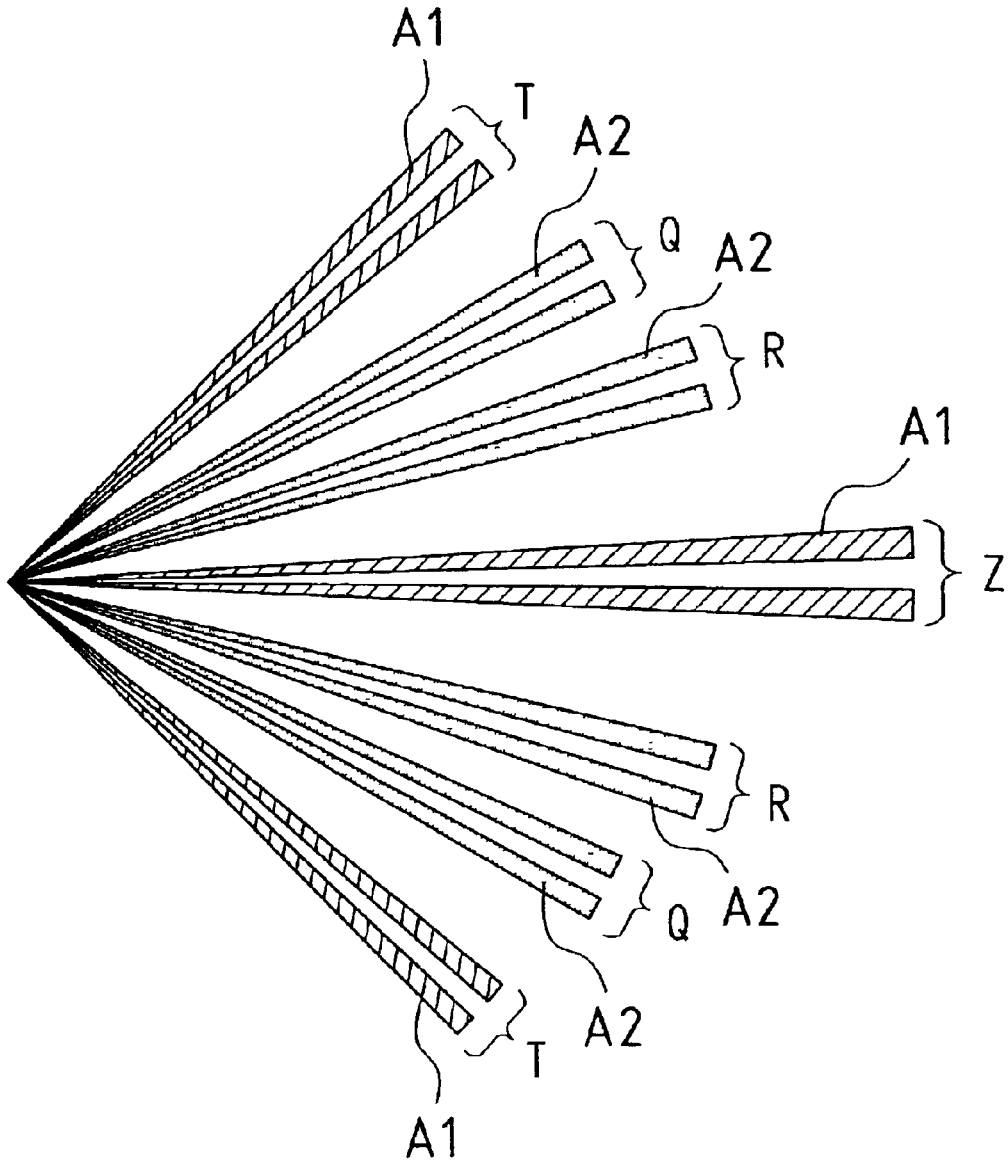
FIG. 13 is a top plan view of the entire detection area concerning Embodiment 3 of the present invention.

Additionally, the proportion and location of the detection areas A1, A2 to be covered by the PIR sensors 21, 22 is not critical, as far as the PIR sensors 21, 22 which together cover the entire detection area A can detect, serially over time, an object which crosses the two detection areas A1, A2 in the direction of entering or exiting from the entire detection area A. As for the entire detection area A, FIG. 13 shows a typical proportion and location of the detection areas A1, A2 to be covered by the PIR sensors 21, 22 of FIG. 12. In this respect, FIG. 12 schematically shows the structure of the sensor unit 2 concerning Embodiment 3, and FIG. 13 is a top plan view of the entire detection area A. The letters Q, R, T and Z in FIG. 13 represent the detection areas A1, A2 to be covered by corresponding sections P, Q, R, S, T, W, X, Y and Z of the PIR sensors 21, 22 in the sensor unit 2 of FIG. 12.

As an exemplary situation, it is supposed that the intruder detection device 1 having the PIR sensors 21, 22 of FIG. 12 is installed in a first-level room, where an opening formed through the floor of the first level provides an access from the ground level. According to the arrangement of FIG. 12, the detection areas A1 of the PIR sensor 21 can include not only a window or a door in the wall, but also the opening through the floor, as illustrated in FIG. 13. Hence, this arrangement is further effective in detecting an intruder.

It should be also understood that incorporation of the detection area changing means does not restrict the installation position of the intruder detection device 1. Thus, wherever required, the intruder detection device 1 is readily suitable for post-mounting.

The invention may be embodied in other specific forms without departing from the spirit or essential characteristics thereof. The above em bodiments are therefore to be considered in all respects as illustrative and not restrictive, the scope of the invention being indicated by the appended claims rather than by the foregoing description. All changes which come within the meaning and range of equivalency of the claims are therefore intended to be embraced therein.

What is claimed is:

1. An intruder detection method for detecting an object which enters detection areas covered by detection elements and outputting a detection signal to a monitoring station, said intruder detection method comprising:

separating an entire detection area into a plurality of detection areas covered by a plurality of detection elements, respectively, with a separation system such that the detection areas do not overlap each other, wherein one of the detection elements covers a detection area which extends at least along an external periphery of the entire detection area;

if an object is detected in one or more detection areas respectively by one or more of the detection elements, generating detection signals from the one or more respective detection elements; and on receiving the detection signals from the one or more respective detection elements, judging that the object is an intruder and outputting the detection signals, independently of each other, to the monitoring station, if the object is detected by the detection element which covers the detection area which extends at least along the external periphery of the entire detection area and the object is later detected by another of the detection elements which covers another detection area.

2. An intruder detection method as recited in claim 1, wherein the separation system comprises a plurality of removable covers that, when selectively removed, operate to separate the object detection elements such that the detection areas do not overlap each other.

3. An intruder detection method for detecting an object and outputting a detection signal to a monitoring station, said intruder detection method comprising:

separating an entire detection area into a plurality of detection areas covered by a plurality of detection elements, respectively, with a separation system such that the detection areas do not overlap each other, wherein one of the detection elements covers a detection area which extends at least along an external periphery of the entire detection area;

if an object is detected in the detection area which extends at least along the external periphery of the entire detection area, waiting for a predetermined time in order to see whether the object is detected in the detection area of another of the detection elements;

if the other detection element detects the object during the predetermined waiting time, judging that the object is an intruder and outputting a detection signal to the monitoring station; and if the other detection element does not detect the object by an end of the predetermined waiting time, judging that the object is not an intruder and cancelling output of the detection signal to the monitoring station.

4. An intruder detection method as recited in claim 3, wherein the separation system comprises a plurality for removable covers that, when selectively removed, operate to separate the object detection elements such that the detection areas do not overlap each other.

5. An intruder detection device for detecting an object and outputting a detection signal to a monitoring station, said intruder detection device comprising:

a sensor unit having a plurality of detection elements operable to detect an object in a plurality of detection areas, respectively, of an entire detection area, wherein one of the detection elements covers a detection area which extends at least along an external periphery of the entire detection area covered by the detection elements;

a separation system operable to separate the object detection areas of the detection elements such that the detection areas do not overlap each other; and a control unit operable to judge a presence or absence of an intruder, wherein the control unit determines the presence of the intruder, if the object is detected by the detection element which covers the external peripheral detection area of the entire detection area, and the object is later detected by another of the detection elements which covers another detection area.

6. An intruder detection device as recited in claim 5, wherein the separation system comprises a plurality of removable covers that, when selectively removed, operate to separate the object detection areas of the detection elements such that the detection areas do not overlap each other.

7. An intruder detection device as claimed in claim 5, wherein the separation system is adjustable such that a portion of the entire detection area covered by each of the detection areas of the plurality of detection elements is changeable.

8. An intruder detection device as claimed in claim 5 or 7, wherein the separation system comprises at least one of a Fresnel lens and a mirror.

9. An intruder detection device as claimed in claim 5 or 7, wherein the detection elements are active infrared sensors.

10. An intruder detection device as claimed in claim 9, wherein the separation system comprises at least one of a Fresnel lens and a mirror.

11. An intruder detection device as claimed in claim 5 or 7, wherein the detection elements are passive infrared sensors.

12. An intruder detection device as claimed in claim 11, wherein the separation system comprises at least one of a Fresnel lens and a mirror.

13. An intruder detection device as claimed in claim 5, wherein the control unit is operable to detect the presence of the intruder if the object is detected in a direction in which the object enters or exits from the entire detection area covered by the detection elements.

14. An intruder detection device as claimed in claim 13, wherein the separation system comprises at least one of a Fresnel lens and a mirror.

15. An intruder detection device as claimed in claim 13, wherein the detection elements are passive infrared sensors.

16. An intruder detection device as claimed in claim 15, wherein the separation system comprises at least one of a Fresnel lens and a mirror.

17. An intruder detection device as claimed in claim 13, wherein the detection elements are active infrared sensors.

18. An intruder detection device as claimed in claim 17, wherein the separation system comprises at least one of a Fresnel lens and a mirror.

* * * * *